US005453242A

United States Patent [19]

Knoess

[11] Patent Number: 5,453,242

[45] Date of Patent: Sep. 26, 1995

[54] PROCESS FOR PRODUCING SINTERED-IRON MOLDED PARTS WITH PORE-FREE ZONES

[75] Inventor: Walter Knoess, Fuessen, Germany

[73] Assignee: Sinterstahl GmbH, Fuessen, Germany

[21] Appl. No.: 38,153

[22] Filed: Mar. 26, 1993

[30] Foreign Application Priority Data

Apr. 4, 1992 [DE] Germany ..... 42 11 319.9

[51] Int. Cl.[6] ..... B22F 3/26; B22F 3/24

[52] U.S. Cl. ..... 419/27; 419/28; 419/49

[58] Field of Search ..... 419/27, 28, 49

[56] References Cited

U.S. PATENT DOCUMENTS

| | | | |
|---|---|---|---|
| 2,561,579 | 7/1951 | Lenel | 75/22 |
| 4,123,265 | 10/1978 | Takahashi et al. | 75/211 |
| 4,470,953 | 9/1984 | Bruce | 419/6 |
| 4,606,768 | 8/1986 | Svilar et al. | 75/246 |
| 4,710,223 | 12/1987 | Matejczyk | 75/248 |
| 4,769,071 | 9/1988 | Klar et al. | 75/246 |
| 4,810,289 | 3/1989 | Hoyer et al. | 75/232 |
| 4,976,778 | 12/1990 | Berry et al. | 75/254 |
| 5,032,353 | 7/1991 | Smarsly et al. | 419/12 |
| 5,126,102 | 6/1992 | Takahashi et al. | 419/2 |
| 5,174,952 | 12/1992 | Jongenburger et al. | 419/23 |
| 5,330,702 | 7/1994 | Kippenberg et al. | 419/28 |

OTHER PUBLICATIONS

English–language translation of Abstract of German Patent No. DE 2258310.

English–language equivalent of Abstract of German Patent No. DE 2310536.

English–language translation of Abstract of German Patent No. DE 3007008.

English–language translation of Abstract of German Patent No. DE 2050276.

English–language equivalent of Abstract of German Patent No. DE 2641899.

*Primary Examiner*—Donald P. Walsh
*Assistant Examiner*—Scott T. Bluni
*Attorney, Agent, or Firm*—Morgan & Finnegan

[57] ABSTRACT

A process for producing from iron materials a sintered molded part which is pore-free in individual zones or boundary zones but porous in the other zones. The process is based on a molded part brought to a residual porosity of about 10% by volume by conventional powder pressing and sintering processes. By additional process steps such as zonal introduction of additional materials or local mechanical recompacting, certain zones or local areas are brought to a residual porosity of 5% by volume or less; at the same time, a closed pore structure is produced in these zones. Under these preconditions, in a final HIP or sintering HIP process step the sintered molded part can be brought to 100% material density in the pretreated zones so that they substantially completely free from pores. The major advantages include local improvement in material properties and calibratability of the finished sintered molded part.

12 Claims, No Drawings

PROCESS FOR PRODUCING SINTERED-IRON MOLDED PARTS WITH PORE-FREE ZONES

FIELD OF THE INVENTION

The invention relates to a process for producing sintered molded parts from iron materials which are pore-free in individual zones or boundary zones and porous in the other zones.

BACKGROUND

Sintered molded parts of iron materials are usually fabricated by pressing powder in axial presses to form green compacts or compressed powder charges, and these are subsequently sintered by largely standardized processes. In these cases, sinter densities of about 90% of the theoretical density are achieved. The sinter density can only be conditionally improved by means of known additional processes, unless other major disadvantages are accepted. Correspondingly, the mechanical strength properties of such sintered molded parts remain inferior to those of molded parts of smelted, 100% dense materials.

The cost advantages of fabrication without generating any chips, that is, loose particles removed from the body, make the sintering technique favorable for use in the production of molded parts. With respect to the dimensions achieved in powder pressing, the finished parts have good dimensional stability and narrow, reproducible dimensional tolerances. Furthermore, on account of the residual porosity existing after sintering, sintered molded parts can be brought, very precisely, to a predetermined reference dimension by pressing.

There are, then, many processes which have become known for bringing conventionally sintered molded parts to at least a uniform, approximately theoretical, i.e., 100%, material density, those conventionally sintered parts being typically of uniform material and, as usual, affected by residual porosity. Powder forging is one of the proposed processes, which does not quite achieve full density. Hot isostatic pressing is a further suitable process which is, however, very elaborate due to the necessary enveloping of the powder and sintered body and is, therefore, unsuitable for mass-produced parts.

The sintering HIP process is a modification of the HIP process, by means of which residual porosities in a sintered part can likewise be eliminated. However, this process also displays many of the restrictions as noted above.

All these processes are used with the aim of improving not only the mechanical properties of sintered molded parts, but also, for example, their corrosive properties. A disadvantage of all these processes is that such a refined sintered molded part becomes a "blank" which has to be further mechanically finished and which to this extent differs significantly from conventionally fabricated sintered parts. Conventionally fabricated sintered molded parts, which are optionally calibrated subsequent to sintering in pressing operations, are generally components which are ready to install.

Furthermore, processes are known for making moldings composed of different materials in different regions, that are as dense as possible and consequently mechanically strong in all regions, of which at least one of these regions is a sintered body.

For instance, DE-A1 22 58 310, entitled "Sinter-eisen-Formteil sowie Verfahren und Sinterkachel zu seiner Herstellung" ("Sintered-iron molded part as well as process and sintering tile for its production"), describes a way by which, during the sintering process, a molded part pressed from iron material "is brought into connection with an agent from which austenite-forming elements diffuse into the surface of the molded part, at least at the sintering temperatures". This causes a material refinement in the surface region, with the aim of improving the surface wear resistance. The finished sintered-iron molded part has porosity in all regions; even in the diffusion region, the molded part has at least "closed porosity" with altogether a maximum of about 95% material density.

According to the teaching of DE-A1 23 10 536, "Verfahren zur Herstillung von Gegenstäanden aus Verbundmetall" ("Process for producing articles from composite metal"), a core part, produced by melt-metallurgy that is thereafter completely dense molded, is placed in the center of a container, with the intermediate space between core and container wall filled with a metal powder The "known" i e container-enclosed, composite is exposed in an autoclave to such high compaction pressures and temperatures on all sides that its density on all sides comes "into the range of 100% of the theoretical density". The composite thus obtained is subsequently forged or rolled out, for example. According to what is claimed, powder densities of more than 95% of the theoretical density are achieved by this process. The composite body is dense in its entirety. This allows composites for use, for example, for the cited application of a milling tool, teeth or other irregular cutting surfaces, wherein the core consists of relatively tough and easily machined metals, while the boundary zones consist of extremely hard material.

DE 30 07 008 describes a wear-resistant part for internal-combustion engines which comprises a basic body of a smelted iron or steel material and an iron-containing sintered body intimately bonded with the basic body by sintering. What is essential for the invention of DE 30 07 008 is the iron alloy proposed for the sintered body. This process too serves the purpose of producing parts "which are distinguished by high toughness in the interior of the body and a particularly high abrasion resistance, at least in a section of their surface."

According to DE-A2 20 50 276, for producing a workpiece with a wear-resistant surface, a wear-resistant hard metal powder is pressed onto and sintered onto a steel basic body. Unlike the sintering of iron materials, hard metal can be produced approximately 100% dense on account of the molten binder phase during sintering. The finished composite body is uniformly dense. A disadvantage in this case is the strong sintering shrinkage, which rules out the production of molded parts in narrowly toleranced reference dimensions without chip-forming, requiring additional finishing. Other disadvantages include material brittleness and material costs.

All the known prior publications have in common the fact that material composites are created by joining together individual material regions by using the sintering technique. The finished material composites have, as far as possible, a high density throughout, in the best case approaching theoretical 100% density. The finished material composites also display individual molded part regions having different mechanical properties, but always with high wear and strength values in the region of surface zones.

Accordingly, in further development of the said prior art, the object of the present invention is to attain, in the case of molded parts of iron materials produced by means of the sintering technique, a high mechanical strength which can be achieved for 100% dense materials in the zones of the molded part which are correspondingly loaded, but which nevertheless allows subsequent calibrating of the sintered molded part.

OBJECT OF THE INVENTION

The object of the invention is specifically to use a combination series of suitable process steps, albeit individually known in each case, to virtually completely eliminate, in individual predetermined zones of a sintered molded part produced by means of conventional sintering, the residual porosity of about 10% by volume which normally remains. That is to say, the invention achieves approximately 100% material density and correspondingly high mechanical strength or wear resistance in these predetermined zones. At the same time, however, in other zones of the sintered molded part, the approximately 10% by volume residual porosity is to be retained or further increased. This is intended to ensure that, as in the use of standard processes, the dimensions of the part achieved by pressing the green compact are retained throughout and that the finished-sintered parts are suitable for final calibrating.

The process to be used is also to have adequate cost-effectiveness for the fabrication of mass-produced parts.

DETAILED DESCRIPTION OF THE INVENTION

The way in which the object described above is achieved according to the invention comprises a process for producing a conventionally sintered molded part from iron materials of the type previously described, according to which a molded part, formed by conventional pressing and sintering processes to a residual porosity of about 10% by volume, is brought in certain zones in a further process step to a residual porosity of 5% by volume or less and simultaneously to a closed pore structure by means of treating those zones with zonal introduction of additional materials into the remaining pores and/or by means of locally effective mechanical recompacting of the molded part. Alternatively, the additional material may be added to the molded part as part of the conventional sintering process and following a pre-sintering step, the additional material infiltrated in its liquid phase migrating into the zones of least porosity adherent to the surface of the molded part during a subsequent conventional sintering step. According to another alternative, the additional material may be added to the molded part during powder mixing and pressing by using a matrix powder having additions for single zones and matrix powder without additions in the other zones. The amount of the additional material may be metered during its application. The entire molded part is subsequently treated by means of the HIP and sintering HIP process. The HIP and sintering HIP process further compacts only the zones which were brought to a residual porosity of 5% by volume or less. All the remaining zones of the sintered molded part cannot be further compacted by the HIP and sintering HIP process and therefore retain their usual, residual porosity of about 10% by volume.

In the present invention, the term "dense, approximately pore-free sintered molded part in individual zones or boundary regions" means, by definition, that these zones are virtually 100% dense, and at the least have a negligible residual porosity of less than 1% by volume.

"Closed pore structure," as known to those skilled in the art, refers to the sintered part have residual porosity in the inner body but having a sealed, no pore structure at the surface.

The powder pressing and sintering processes characterized as "conventional" for sintered molded parts of iron materials are described with a great range of variations in the relevant standard literature. The individual additional process steps essential for the invention likewise comprise processes with a great range of variations well-established in sintering technology and known to a person skilled in the art. Preferred configuration details are specified in the subclaims and in the examples.

The regularly used brief designation HIP process is intended to mean the hot isostatic recompacting of sintered molded parts. In the case of the sintering HIP process, the processes of sintering and hot isostatic recompacting proceed simultaneously and side-by-side. In the following exemplary embodiments, one in the art is referred specifically to the description.

The following configurations of the process according to the invention have proved particularly successful.

Of the additional materials which can be introduced into the basic matrix of the iron material, preferred are those which are molten below the usual sintering temperature of iron materials. The group of such additional materials includes: copper, manganese, nickel, phosphorus and/or boron. These additional materials can infiltrate into the pores of the basic material as a liquid phase by utilizing the capillary forces of the pores during the sintering of the molded part. The additional materials can also be introduced into delimitable zones, for example, into superficial boundary zones of predetermined thickness.

The additional materials may fulfill the function of a straightforward pore filler, but, for example, according to a preferred embodiment of the inventive process, with corresponding heat treatment they may also be alloyed, at least to a partial extent, with the basic iron material.

During sintering, it has proved successful in practice with compacts composed of different types of elements to allow a liquid phase, which forms within individual zones, to migrate selectively into predetermined other zones of the sintered molded part.

The superficial recompacting of sintered materials by means of mechanical pressing or rolling is known per se. For the production of sintered molded parts according to the present invention it has proved to be particularly advantageous to recompact boundary zones of sintered molded parts to a residual porosity by 5% by volume or less by rotary forging.

The process according to the invention allows the production of sintered molded parts from iron materials in which the advantages of molded parts produced by conventional pressing and sintering processes, such as particular dimensional stability, calibratability and cost-effectiveness, are combined with the advantageous properties of high material density and high mechanical strength in individual highly loaded zones. The increase in mechanical strength and wear resistance is of particular importance, for example, in the region of the tooth flanks of a gear wheel.

It is crucial for the success of the overall process and essential for the invention to bring the customary pore volume of the basic sintered material initially to values of 5% by volume or less zone-by-zone, and to generate a "closed" porosity in these zones. Only then can corresponding zones be brought subsequently to 100% density by HIP or sintering HIP. The remaining sintered molded part with porosity of about 10% by volume throughout, i.e. convention porosity, remains uninfluenced by the recompacting measures.

The process according to the invention is explained in more detail below by taking individual examples.

EXAMPLE 1

An annular sintered body is produced as a composite body from two different powders.

Powder type 1 is a commercially available iron powder, such as is available commercially, for example, under the trade name ASC.

Powder type 2 is an iron-copper alloy FeCu20, as is likewise commercially available.

An annular mold is filled on the inside, i.e., in the region close to the axis, with iron powder ASC, and on the outside with an iron-powder alloy FeCu20. The powder composite, initially pressed together under 6 $t/cm^2$, undergoes the following transformation during the subsequent sintering:

The outer annular region of the sintered body originally containing FeCu20, is evacuated of the Cu phase, and is consequently highly porous after sintering involving liquid phase formation. By contrast, the inner part of the ring has filled with copper when said copper becomes liquid, due to the higher capillary forces occurring in the pores in the inner region. The inner region has a low residual porosity which is eliminated in a following process step by sintering HIP. The low residual porosity of the inner region can be detected by conventional means such as a micrograph. The outer part of the ring remains highly porous. After the sintering HIP process, the sintered molded part is calibrated.

EXAMPLE 2

An annular sintered molded part is produced using commercially available iron powders by conventional pressing and sintering processes and has the normal density of about 90% of the theoretical density. The surface zone of the ring away from the axis is subsequently compacted by rolling to a depth of 0.5 mm–1 mm, with increasing density from the inside towards the surface, amounting to about 95% density in the surface area and to closed pore structure immediately at the surface. By means of subsequent HIP or sintering HIP, a narrow boundary layer of the surface zone is brought to the desired 100% density.

In the event that one wishes to widen the 100% dense zone of limited width that can be achieved by means of rolling, a defined amount of a liquid Cu phase is introduced into the sintered molded part, after rolling but prior to subsequent HIP or sintering HIP, by means of an impregnation process. In this case, preferably, the liquid phase is included in the boundary region already compacted by rolling but not already compacted to 100% density, because higher capillary forces occur in this region on account of the smaller pore dimensions. The infiltrated liquid phase still has a "closed residual porosity". By HIP, a widened boundary zone is 100% compacted, whereas the normal porosity is retained in the interior of the sintered part. The ring is subsequently calibrated to exact dimensions.

EXAMPLE 3

A sintered molded part produced by conventional pressing and sintering processes is compacted within defined zones by mechanical repressing to such an extent that, during a subsequent sintering HIP operation, a liquid phase can be infiltrated. The liquid phase initially collects in the smaller pores of the recompacted region on account of the greater capillary forces there, and then, by means of the process of liquid-phase sintering, results in compacted zones of closed porosity.

The subsequent sintering HIP process results in molded parts with a pore-free zone. Outside the pretreated zones, the original, open porosity in the sintered molded part remains unchanged.

In a final calibrating operation, the sintered molded part is shaped into a dimensionally exact component, i.e. with narrow dimensional tolerances.

EXAMPLE 4

A gear wheel with about 90% density, produced by conventional pressing and sintering processes, and using commercially available powdered basic iron materials, is coated in the region of the teeth contours with a basic boron or phosphorus alloy mixed into a paste. These additional alloys serve as liquid-phase formers. During the subsequent heating-up of the molded part to sintering temperature in a sintering HIP process, in a first substep the coated-on additional materials of boron or phosphorus become molten and diffuse into the boundary zones of the sintered molded part or are drawn into a boundary zone of 0.5 to 1 mm thickness on account of the capillary forces prevailing in the pores. The composite thus obtained has in the boundary zone with inclusions a closed porosity, i.e. at least 95% density. This closed residual porosity is completely eliminated in a second substep of the sintering HIP process.

The gear wheels thus obtained have a pore-free, 100% dense and high-strength surface zone in the tooth region, the strength of the surface approaching or being equivalent to that of corresponding smelted steel materials. The other zones of the gear wheel retain their original porosity. In a final process step, the gear wheel of corresponding construction is calibrated.

I claim:

1. A process for producing from iron materials a sintered molded part which is pore-free in individual zones or boundary zones and porous in other zones, wherein a molded part is brought to a residual porosity of about 10% by volume of said part by conventional powder pressing and sintering processes, said part thereafter brought in a further process step to a residual porosity of about 5% by volume or less and to a closed pore structure in certain of said zones by means of zonal introduction of additional materials into remaining pores in said part and/or by means of locally effective mechanical recompacting of the molded part, said molded part subsequently further treated by means of the HIP or sintering HIP process to lead to further compactness in said certain of said zones.

2. The process for producing a sintered molded part as claimed in claim 1, wherein said additional materials comprise materials which are molten below the usual sintering temperature of the iron materials forming said molded part.

3. The process for producing a sintered molded part as claimed in claim 2, wherein said additional materials are selected from the group consisting of Cu, Mn, Ni, P and/or B.

4. The process for producing a sintered molded part as claimed in claim 1, wherein, as part of the conventional sintering process of the molded part, after an initial pre-sintering step of the iron materials and during a subsequent sintering step the additional materials which are in a liquid phase, are infiltrated into the pores of surface zones of the molded part.

5. The process for producing a sintered molded part as claimed in claim 1, wherein the additional materials are applied in a metered amount to the surface of the conventionally pre-sintered iron materials, said additional materials infiltrated into said molded part and included in the adherent surface zones of least porosity during a subsequent conventional sintering step of the molded part when the melting temperature of said additional materials is reached.

6. The process for producing a sintered molded part as claimed in claim 1, wherein the iron materials are alloyed with the introduced additional materials in the sintered molded part.

7. The process for producing sintered molded parts as claimed in claim 1, wherein individual boundary zones of the sintered molded part are recompacted by means of rotary forging to a residual porosity not greater than 5% of the volume of said molded part.

8. A sintered molded part, produced by the process as claimed in claim 1, wherein subsequent to said HIP or sintering HIP process said molded part has approximately the same dimensions as after said conventional powder pressing processes.

9. The process for producing a sintered molded part as claimed in claim 2, wherein, as part of the conventional sintering process of the molded part, after an initial pre-sintering step of the molded part and during a subsequent sintering step the additional materials which are in a liquid phase are infiltrated into the pores of the molded part.

10. The process for producing a sintered molded part as claimed in claim 2, wherein the additional materials are applied in a metered amount to the surface of the molded part prior to conventional sintering said additional materials infiltrated into said molded part and included in the adherent surface zones of least porosity during the conventional sintering step of the molded part when the melting temperature of said additional materials is reached.

11. The process for producing a sintered molded part as claimed in claim 3, wherein the additional material is applied in a metered amount to the surface of the conventionally first step pre-sintered iron material, said additional material infiltrated into said molded part and included in the adherent surface zones of least porosity during a subsequent conventional sintering step of the molded part when the melting temperature of said additional material is reached.

12. The process for producing a sintered molded part as claimed in claim 2, wherein the iron materials are alloyed with the introduced additional materials in the sintered molded part.

* * * * *